United States Patent [19]

Neal

[11] Patent Number: 4,606,886

[45] Date of Patent: Aug. 19, 1986

[54] TITANIUM-BASE ALLOY

[75] Inventor: Donald F. Neal, Tamworth, England

[73] Assignee: IMI Titanium Limited, Birmingham, England

[21] Appl. No.: 677,481

[22] Filed: Dec. 3, 1984

[30] Foreign Application Priority Data

Dec. 10, 1983 [GB] United Kingdom ..... 8333043

[51] Int. Cl.[4] ..... C22C 14/00

[52] U.S. Cl. ..... 420/419; 148/407

[58] Field of Search ..... 420/419; 148/407, 421, 148/11.5 F, 12.7 B

[56] References Cited

U.S. PATENT DOCUMENTS

| | | | |
|---|---|---|---|
| 3,061,427 | 10/1962 | Luhan | 420/419 |
| 3,540,946 | 11/1970 | Minton et al. | 420/419 |
| 3,619,184 | 11/1971 | Bomberger, Jr. et al. | 420/419 |

FOREIGN PATENT DOCUMENTS

| | | | |
|---|---|---|---|
| 944954 | 12/1963 | United Kingdom | 420/419 |
| 1124324 | 8/1968 | United Kingdom | 420/419 |
| 1124114 | 8/1968 | United Kingdom | 420/419 |
| 1298923 | 12/1972 | United Kingdom | 420/419 |

*Primary Examiner*—L. Dewayne Rutledge
*Assistant Examiner*—Robert L. McDowell
*Attorney, Agent, or Firm*—Cushman, Darby & Cushman

[57] ABSTRACT

A high strength titanium alloy capable of being used at elevated temperatures, the alloy containing 3.5–5.65% aluminium, 3.0–8.1% tin, with a total aluminium equivalent in the range 6.1–6.8%, 4.5–7.5% zirconium, 1.5–3% molybdenum, 0.2–0.6% silicon, balance titanium apart from incidental impurities, the alloy having good hardenability and having uniform hardenability throughout its depth, the alloy being weldable, resistant to crack propagation and having a good balance of properties suitable for use in applications requiring high strength at elevated temperatures.

7 Claims, 4 Drawing Figures

UTS
5
0.2%PS
6
7
RinA
UTS(Nmm-2)
REDUCTION IN AREA %
1250
1200
1150
1100
1050
1000
950
25
20
15
10
5
0
11 9 7 Sn% 3 1 0
2 2.5 3 3.2 3.8 4 5 5.2 5.7 6 6.2
Al%

8
9
10
UTS(Nmm-2)
REDUCTION IN AREA %
950
900
850
800
750
700
650
50
40
30
20
10
0
11 9 7 Sn% 3 1 0
2 2.5 3 3.2 3.8 4 5 5.2 5.7 6 6.2
Al %

TITANIUM-BASE ALLOY

BACKGROUND OF THE INVENTION

This invention relates to titanium alloys and has particular reference to titanium alloys intended for use at high temperatures.

In aerospace applications, particularly in aero-engines, the need to develop more efficient engines leads inevitably to a need to develop alloys capable of withstanding high temperatures in use. In many cases the alloys are developed specifically for their high creep strength at elevated temperatures. In some cases, however, the levels of creep strength are somewhat less important than the absolute levels of strength which the alloy can withstand. It will be appreciated that creep comprises extension of the alloy under load over long periods of time at elevated temperatures. Strength is more concerned with the ability of the alloy to withstand high loads not necessarily imposed for particularly long periods of time.

The present invention is concerned with the development of an alloy which has a fine and good balance of properties including resistance to crack propagation, high strength at elevated temperatures, weldability, a reasonable density and reasonable ductility. The alloys are frequently used in large sections. In such sections the ability of the material to be used in the welded condition is such that it enables engines to be designed to be assembled by welding.

By "weldable" as is used herein is meant that the material can be used commercially in the welded condition and has a micro-structure such that it can be used in the welded condition. The term weldable is not intended when used herein merely to mean that two pieces of the alloy can be joined together by welding.

Because the alloys of the present invention are frequently used in large sections it is important that the matter of depth hardenability be considered. The alloys of the present invention, as is common with most, if not all, titanium alloys, are used in the heat treated condition. The alloys are not used in the as-cast condition. Clearly if the alloy is heat treated by a process which involves quenching or fast cooling it is important that the properties of the alloy should be reasonably constant throughout the section.

The present invention is concerned with alloys which are heat treatable such that the properties are relatively independent of the thickness of the section treated and the present invention is, in part, based on the unexpected discovery that certain compositions may be heat treated by quenching without giving large variations in all the mechanical properties through thick sections.

As used herein the term "aluminium equivalent" means the total of aluminium in weight percent plus one-third of the total percentage of tin in weight percent. Thus the aluminium equivalent equals % Al+% Sn/3.

SUMMARY OF THE INVENTION

By the present invention there is provided a titanium alloy which includes by weight 3.5–5.65% aluminium, 3.0–8.1% tin, with a total aluminium equivalent in the range 6.1–6.8%, 4.5–7.5% zirconium, 1.5–3% molybdenum, 0.2–0.6% silicon, balance titanium apart from incidental impurities.

The aluminium content preferably is selected from the range 3.5–5.3% or 3.75–4.75%, or 4–4.5% and is further preferably 4%. The aluminium content may alternatively be selected from the range 5.35–5.65% or 5.55–5.65% and is further preferably 5.6%.

The tin content preferably is selected from the range 3.5–8.1%, 4–7.5%, 5–7.3%, 6–7.2% and is further preferably 7%. The tin content may alternatively be selected from the range 3.5–4.0% or 3.5–3.75% and is further preferably 3.5%.

The zirconium content may be in the range 5.0–7.0%, 5.5–6.5% and may further preferably be in the range 5.5–6.0% or may be 5.0%, 5.5% or 6%.

The molybdenum content may be selected from the ranges 1.75–2.75%, 2.0–2.5% or may be 2.0%, 2.25% or 2.5%.

The silicon content may be in the range 0.3–0.6%, 0.3–0.5% and may be 0.3%, 0.35% or 0.4%.

The alloy may be 4% Al, 7% Sn, 6% Zr, 2.5% Mo, 0.4% Si balance titanium or 5.6% Al, 3.5% Sn, 6% Zr, 2.5% Mo, 0.4% Si balance titanium.

The alloy is suitable for use in the welded condition eg for turbine discs which are welded together typically by electron-beam welding to form a drum in a gas turbine engine.

BRIEF DESCRIPTION OF THE DRAWINGS

By way of example embodiments of the present invention will now be described with reference to the accompanying drawings, of which.

DESCRIPTION OF THE PREFERRED EMBODIMENTS

At 500° C. the property which has to be optimised for alloys of the present type is strength. Strength is, as is well known, related to the hardness of the material. The hardness may readily be measured by a suitable machine such as a Vickers' pyramidal hardness machine.

Alloys of the present invention are conventionally used in the solution treated, quenched and aged condition. To simulate such treatment for various depths of material the alloys were formed into rods and the rods were tested in a Jominy end quench apparatus. A Jominy end quench machine comprises apparatus for suspending a rod of metal which has been heated to a high temperature and then quenching the rod from one end with a spray of water. Clearly the quenching is most rapid where the water contacts the end of the rod and the rod cools by conduction. Thus the sample more remote from the end of the rod is cooled more slowly. It can be seen, therefore, that a Jominy end quench test simulates the effect of section size in a normal quenching arrangement. When thin sections are quenched virtually the entire section cools at the same high cooling rate. However, where large sections, such as 100 mm thick sections, are quenched the rate of cooling of the outside is much greater than the rate of cooling of the inside. Such a rate of cooling can affect the eventual properties of the sample being quenched. It will be appreciated that it is preferred that the material has a constant property throughout its depth.

Figure 1:
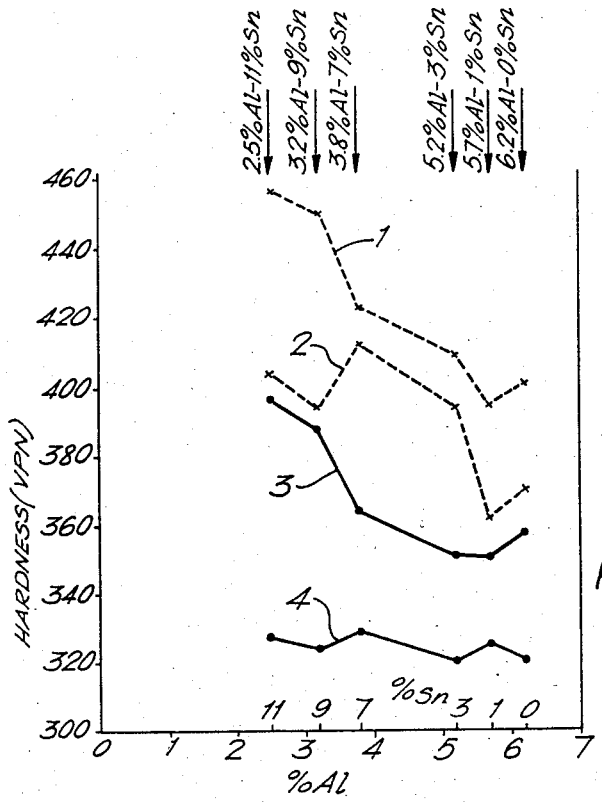
FIG. 1 is a graph of hardness against percentage aluminium/tin for alloys of constant aluminium equivalent.

It has been discovered that hardenability varies significantly with alloys of the same aluminium equivalent but with differing aluminium content. In FIG. 1 there is shown a series of graphs in which the hardness of the alloy base 7.5% zirconium, 2% molybdenum, 0.4% silicon, plus aluminium, plus tin, balance titanium is measured, the composition selected at a constant aluminium equivalent of approximately 6.2% which corresponds to % Al+% Sn/3. The particular nominal compositions were as follows:

2.5% aluminium plus 11% tin
3.2% aluminium plus 9% tin
3.8% aluminium plus 7% tin
5.2% aluminium plus 3% tin
5.7% aluminium plus 1% tin
6.2% aluminium plus 0% tin The lines 1 and 2 show the hardness in VPN measured for the alloys indicated by the crosses in which the alloys have been solution treated at 900° C., water quenched in the Jominy end quench machine and aged at 500° C. for 24 hours and air cooled. Line 1 corresponds to the maximum hardness measured, ie the hardness measured nearest the end which is quenched by the water. Line 2 corresponds to the minimum hardness measured along the length of the sample. Similarly lines 3 and 4 correspond to the maximum and minimum hardnesses respectively for material which had been solution treated at 900° C. and water quenched in the Jominy end quench apparatus but not given a subsequent ageing. The highest hardness values at the surface (lines 1 and 3) arise when the tin is at its highest value (11%) and the aluminium at its lowest level (2.5%).

Figure 2:
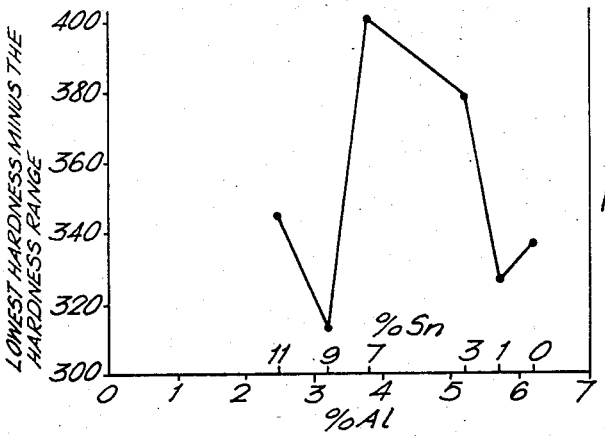
FIG. 2 is a graph of minimum hardness minus hardness range against percentage aluminium/tin.

FIG. 2 is a graph derived from FIG. 1 in which the difference in hardenability along the length of the sample, together with the absolute level of hardness, is related to composition. The points on FIG. 2 are derived by taking the lowest value of hardness (line 2) from FIG. 1 for material which had been solution treated, quenched and aged ie equivalent to material at the centre of a section being quenched, and subtracting from said value the difference between the maximum hardness (line 1) and the minimum hardness (line 2) for said material. The resulting number (minimum hardness minus the hardness range) represents the extent of the difference between hardness values at the centre of a forged and quenched section and hardness values at the surface of the same section. FIG. 2 shows the value of lowest hardness minus the hardness range plotted against aluminium content. Unpredictably it shows a distinct peak with the optimum composition being somewhere between 3.2% aluminium and 5.7% aluminium.

These results for the aged alloys indicate that the alloys are capable of being hardened most uniformly and to the highest degree if the aluminium and tin contents are kept within the range 3.5% to 5.6% aluminium and 3.0% to 8.1% tin. Provided such aluminium and tin quantities are used and provided the aluminium equivalent is in the range 6.1% to 6.8% the material may be hardened by quenching to a very significant extent and the hardness is not significantly affected by section size.

It will be appreciated that this is a most important discovery in that it enables sections which are thick to be heat treated knowing that the material properties will not vary significantly throughout the depth of the section.

Figure 3:
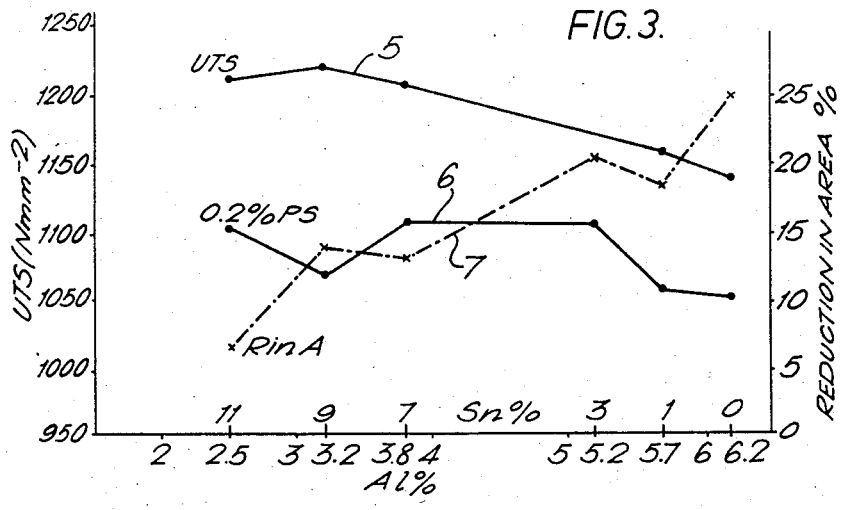
FIG. 3 is a graph of UTS, 0.2% proof strength and reduction in area against various aluminium/tin levels for tests measured at room temperature.
Figure 4:
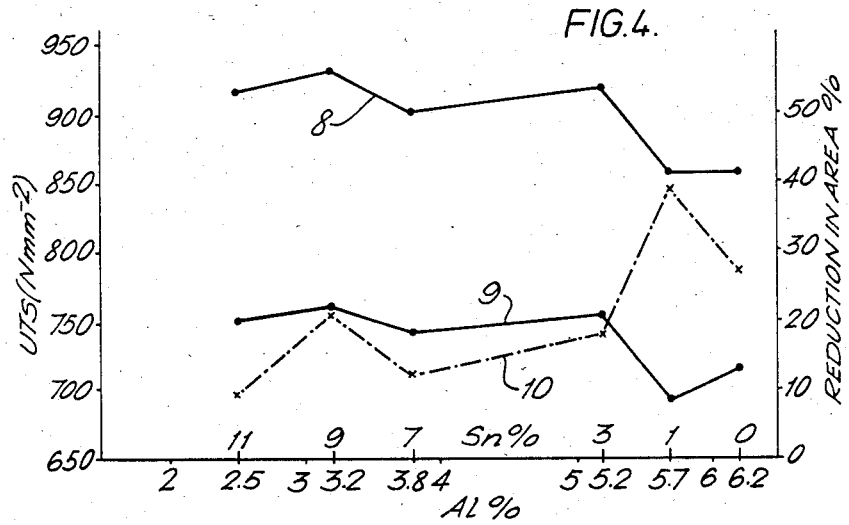
FIG. 4 is a graph of UTS, 0.2% proof strength and reduction in area against various aluminium/tin levels for tests measured at 450° C.

As will be shown below with reference to FIGS. 3 and 4 the mechanical properties of the alloys in the unhardened state are relatively insensitive to variations in the percentages of aluminium and tin for a constant aluminium equivalent. FIGS. 3 and 4 relate to beta processed material which has been stabilised by heat treatment at 600° C. for 8 hours, to enable testing to take place on material which has not been deliberately subjected to a hardening process.

Referring to FIG. 3 this shows the mechanical properties, ie the ultimate tensile strength (UTS), the 0.2% proof strength and reduction in area, for the same alloys mentioned above. The aluminium equivalent is about 6.2%. Line 5 shows the ultimate tensile strength of the alloys and it can be seen that there is a very gradual decline as the tin content reduces. In all cases, however, the ultimate tensile strength is adequate. The 0.2% proof strength shown by line 6 remains virtually constant irrespective of the percentage of aluminium or tin. As might be expected the ductility of the alloy as shown by the reduction in area line 7 shows a gradual increase with increasing aluminium content and is substantially a mirror of the UTS line 5. It can be seen, therefore, that the properties of the alloy measured in room temperature tensile tests is not significantly affected by changing the amounts of aluminium and tin and the sensitivity shown in the hardness tests is not apparent from the room temperature tensile tests on unhardened material.

The elevated temperature tensile tests carried out at 450° C. give similar results. The ultimate tensile strength of the alloys is given by line 8 and it can be seen that there is a gradual fall with the increasing aluminium content. The 0.2% proof strength shown by line 9 again has a gradual fall whereas the ductility of the alloy as shown by the reduction in area line 10 shows a gradual increase with increasing aluminium contents.

It can be seen, therefore, that the ductility of the alloy and the strength of the alloy, when measured in tensile tests carried out at 450° C. on unhardened material, is substantially unaffected by variations in the aluminium and tin contents for a constant aluminium equivalent.

In the unhardened state, the strength of the material is relatively unaffected by composition. It is very surprising therefore, given this evidence, that the hardenability is so sensitive to composition as is shown clearly in FIG. 2.

It has been found that the balance between zirconium and molybdenum is important, in that zirconium gives a more equiaxed structure whereas molybdenum gives a more acicular structure after beta processing. By balancing the molybdenum and zirconium contents the desired structure can be obtained.

In addition to having very good hardenability characteristics the alloy may be used in the welded condition, is resistant to crack propagation, has a good strength, can readily be processed and has a good balance of properties.

I claim:

1. A titanium alloy containing 5.35–5.65% aluminium, 3.0–3.75% tin, with a total aluminium equivalent, being the total percentage of aluminium in weight per cent plus one third of the total percentage of tin in weight per cent, in the range 6.1–6.8%, 4.5–7.5% zirconium, 1.5–3% molybdenum, 0.2–0.6% silicon, balance titanium apart from incidental impurities.

2. A titanium alloy as claimed in claim 1 in which the aluminium content is 5.55–5.65%.

3. A titanium alloy as claimed in claim 1 or claim 2 in which the tin content is 3.5–3.75%.

4. A titanium alloy as claimed in claim 1 in which the zirconium content is selected from the range 5.0–7.0%, 5.5–6.5% or 5.5–6.0%.

5. A titanium alloy as claimed in claim 1 in which the molybdenum content is selected from the range 1.75–2.75% or 2.0–2.5%.

6. A titanium alloy as claimed in claim 1 in which the silicon content is selected from the range 0.3–0.6% or 0.3–0.5%.

7. A titanium alloy containing 5.6% Al, 3.5% Sn, 6% Zr, 2.5% Mo and 0.4% Si, the balance being titanium and incidental impurities.

* * * * *